US011685999B2

(12) United States Patent
Janik et al.

(10) Patent No.: US 11,685,999 B2
(45) Date of Patent: Jun. 27, 2023

(54) AQUEOUS ELECTROLESS NICKEL PLATING BATH AND METHOD OF USING THE SAME

(71) Applicant: MacDermid Acumen, Inc., Waterbury, CT (US)

(72) Inventors: Robert Janik, Pinckney, MI (US); Nicole J. Micyus, South Lyon, MI (US); Ryan Schuh, Saint Peter, MN (US)

(73) Assignee: MacDermid Acumen, Inc., Waterbury, CT (US)

( * ) Notice: Subject to any disclaimer, the term of this patent is extended or adjusted under 35 U.S.C. 154(b) by 438 days.

(21) Appl. No.: 14/293,216

(22) Filed: Jun. 2, 2014

(65) Prior Publication Data

US 2015/0345027 A1 Dec. 3, 2015

(51) Int. Cl.
*B05D 3/10* (2006.01)
*C23C 18/36* (2006.01)

(52) U.S. Cl.
CPC ..... *C23C 18/36* (2013.01)

(58) Field of Classification Search
CPC .. C23C 18/36; C23C 18/1655; C23C 18/1675
USPC ..... 427/443.1, 438, 304, 305, 306
See application file for complete search history.

(56) References Cited

U.S. PATENT DOCUMENTS

| | | | | | |
|---|---|---|---|---|---|
| 3,887,732 | A * | 6/1975 | Parker | C23C 18/36 | 148/253 |
| 3,953,624 | A | 4/1976 | Arnold | | |
| 4,397,812 | A | 8/1983 | Mallory, Jr. | | |
| 4,483,711 | A * | 11/1984 | Harbulak | C23C 18/36 | 106/1.22 |
| 4,600,609 | A * | 7/1986 | Leever | C23C 18/34 | 106/1.22 |
| 5,494,710 | A | 2/1996 | Mallory, Jr. | | |
| 5,609,767 | A * | 3/1997 | Eisenmann | C23C 18/1617 | 106/1.22 |
| 6,020,021 | A | 2/2000 | Mallory, Jr. | | |
| 6,048,585 | A * | 4/2000 | Martyak | C23C 18/1617 | 106/1.22 |
| 6,146,702 | A * | 11/2000 | Zitko | C23C 18/50 | 427/376.6 |
| 6,800,121 | B2 * | 10/2004 | Shahin | C23C 18/36 | 106/1.22 |
| 7,833,583 | B2 | 11/2010 | Pearson et al. | | |
| 7,846,503 | B2 | 12/2010 | Stark et al. | | |
| 2001/0030366 | A1 * | 10/2001 | Nakano | H01L 21/288 | 257/758 |
| 2007/0014923 | A1 * | 1/2007 | Ivanov | C23C 18/1651 | 427/304 |
| 2009/0075089 | A1 | 3/2009 | Ohta et al. | | |
| 2011/0114498 | A1 | 5/2011 | Tremmel | | |
| 2011/0200842 | A1 * | 8/2011 | Uhlig | C23C 18/1601 | 428/652 |
| 2012/0156387 | A1 * | 6/2012 | Stark | C07C 229/08 | 427/437 |

FOREIGN PATENT DOCUMENTS

| | | | | |
|---|---|---|---|---|
| CN | 101314848 | | 12/2008 | |
| CN | 102892924 | A | 1/2013 | |
| EP | 0 071 436 | | 2/1983 | |
| EP | 1932943 | | 6/2008 | |
| EP | 2 551 375 | | 1/2013 | |
| GB | 2 155 041 | | 6/1987 | |
| JP | 62-502972 | | 11/1987 | |
| JP | H04-157169 | A | 5/1992 | |
| JP | 06-033255 | | 2/1994 | |
| JP | 06-065749 | | 3/1994 | |
| JP | 11-323567 | | 11/1999 | |
| JP | 2005-163153 | | 6/2005 | |
| JP | 2006-169605 | | 6/2006 | |
| KR | 10-2012-0050999 | A | 5/2012 | |
| WO | 86/06754 | | 11/1986 | |
| WO | 2011/003116 | A2 | 1/2011 | |
| WO | WO-2013182489 | A2 * | 12/2013 | C23C 18/1633 |

OTHER PUBLICATIONS

Hu, Xin-guo, "Study on Corrosion Resistance Coating of High Phosphorus Ni—P Alloy," Collection of Papers of "99 Sixth Session of the Both Sides of the Strait Surface Finishing Association, pp. 102-111, Sep. 1, 1999 (English Abstract).

Hu, Xin-Guo, "The Latest Development of the Non-Pollution Electroless Neckel Plating Technology," pp. 147-152, Dec. 31, 2002 (English Abstract).

Qu, Yuping, "Preparation of Electroless Ni—P on Magnesium Alloys and Study of Corrosion-Resistance," China Excellent Master's Thesis Full-Text Database (Master) Engineering Science Series I, No. 2, Feb. 15, 2006.

Translation of First Office Action issued in corresponding Chinese Office Action (Application No. 201580029221.4) dated Jul. 23, 2018.

Translation of Second Office Action issued in corresponding Chinese Office Action (Application No. 201580029221.4) dated Jan. 17, 2019.

Translation of Third Office Action issued in corresponding Chinese Office Action (Application No. 201580029221.4) dated Jul. 11, 2019.

* cited by examiner

*Primary Examiner* — Dah-Wei D. Yuan
*Assistant Examiner* — Nga Leung V Law
(74) *Attorney, Agent, or Firm* — Carmody Torrance Sandak & Hennessey LLP

(57) ABSTRACT

An electroless nickel plating solution and a method of using the same to produce a nickel deposit having a phosphorus content that remains at about 12% throughout the lifetime of the electroless nickel plating solution is disclosed. The electroless nickel plating solution comprises (a) a source of nickel ions; (b) a reducing agent comprising a hypophosphite; and (c) a chelation system comprising: (i) one or more dicarboxylic acids; and (ii) one or more alpha hydroxy carboxylic acids. The electroless nickel plating solution may also comprise stabilizers and brighteners.

14 Claims, No Drawings

AQUEOUS ELECTROLESS NICKEL PLATING BATH AND METHOD OF USING THE SAME

FIELD OF THE INVENTION

The present invention relates generally to a nickel-phosphorus plating bath for the electroless deposition of nickel phosphorus alloys.

BACKGROUND OF THE INVENTION

Electroless nickel coatings are functional coatings that are applied to provide corrosion resistance, wear resistance, hardness, lubricity, solderability and bondability, uniformity of deposit, and non-magnetic properties (in the case of high-phosphorus nickel alloys), to provide a non-porous barrier layer or otherwise enhance the performance or useful life of a particular component. The hardness and corrosion resistance of electroless nickel are key factors in many successful applications. Electroless nickel coatings are used for a variety of applications including electrical connectors, microwave housings, valves and pump bodies, printer shafts, computer components, among others. Electroless nickel may be used to coat components made of various materials, including, but not limited to, steel, stainless steel, aluminum, copper, brass, magnesium and any of a number of non-conductive materials.

Electroless nickel plating deposits a nickel alloy onto a substrate that is capable of catalyzing the deposition of the alloy from a process solution containing nickel ions and a suitable chemical reducing agent capable of reducing nickel ions in solution to metallic nickel. Various additives are also used in the electroless nickel plating bath to stabilize the bath and further control the rate of nickel deposition on the substrate being plated. Reducing agents include, for example, borohydride (which produces a nickel boron alloy) and hypophosphite ions (which produces a nickel phosphorus alloy). In contrast with electroplating, electroless nickel does not require rectifiers, electrical current or anodes. The deposition process is autocatalytic, meaning that once a primary layer of nickel has formed on the substrate, that layer and each subsequent layer becomes the catalyst that causes the plating reaction to continue.

In electroless nickel plating baths employing hypophosphite ions as the reducing agent, the nickel deposit comprises an alloy of nickel and phosphorus with a phosphorus content of from about 2% to more than 12%. These alloys have unique properties in terms of corrosion resistance and (after heat treatment) hardness and wear resistance.

Deposits from nickel phosphorus baths are distinguished by phosphorus content, which in turn determines deposit properties. The percentage of phosphorus in the deposit is influenced by a number of factors, including, but not limited to, bath operating temperature, the operating pH, the age of the bath, concentration of hypophosphite ions, concentration of nickel ions, the phosphite ion and hypophosphite degradation product concentration as well as the total chemical composition of the plating bath including other additives.

Low phosphorus deposits typically comprise about 2-5% by weight phosphorus. Low phosphorus deposits offer improved hardness and wear resistance characteristics, high temperature resistance and increased corrosion resistance in alkaline environments. Medium phosphorus deposits typically comprise about 6-9% by weight phosphorus. Medium phosphorus deposits are bright and exhibit good hardness and wear resistance along with moderate corrosion resistance. High phosphorus deposits typically comprise about 10-12% by weight phosphorus. High phosphorus deposits provide very high corrosion resistance and the deposits may be non-magnetic (especially if the phosphorus content is greater than about 11% by weight).

Heat treatment of the electroless nickel deposit (at temperatures of at least about 520° F.) will increase the magnetism of the deposit. Additionally, even deposits that are typically non-magnetic as plated will become magnetic when heat-treated above about 625° F. The hardness of electroless nickel coatings may also be enhanced by heat treatment and is dependent on phosphorus content and heat treatment time and temperature.

In spite of the many advantages of electroless nickel deposits from an engineering point of view, the deposition of electroless nickel generates significant waste. Most of the hypophosphite used to reduce the nickel becomes oxidized to phosphite which remains in the process solution and builds up in concentration until the bath must be replaced. During operation of the bath, the pH tends to fall and is corrected either by the addition of ammonia or potassium carbonate solutions. Again, these ions build up in concentration during bath operation. Eventually, the bath reaches saturation (or, before this, the rate of metal deposition becomes too slow for commercial operation) and has to be replaced. At the point of disposal, the waste solution typically contains nickel ions, sodium ions (from sodium hypophosphite), potassium and/or ammonium ions hypophosphite ions, phosphite ions, sulfate ions and various organic complexants (such as lactic acid or glycolic acid).

In addition, during the plating process, the nickel and hypophosphite ions are continuously depleted and must be replenished in order to maintain the chemical balance of the bath. Plating quality and efficiency decrease as the phosphite level increases in the solution, and it becomes necessary to discard the plating bath, typically after the original nickel content has been replaced four times through replenishment. This is known in the art as metal "turnover" (MTO).

As described herein, a typical electroless nickel bath comprises:

a) a source of nickel ions;

b) a reducing agent; and c) one or more complexing agents.

Stabilizers are added to provide a sufficient bath lifetime, good deposition rate and to control the phosphorus content in the as-deposited nickel phosphorus alloy. Common stabilizers and brighteners are selected from heavy metal ions such as cadmium, thallium, bismuth, lead, and antimony ions, and various organic compounds such as thiourea. However, many of these stabilizers and brighteners are toxic and are the subjected of increased regulation. As noted for example in U.S. Pat. No. 4,483,711 to Harbulak, the subject matter of which is herein incorporated by reference in its entirety, the addition of thiourea to an electroless nickel bath has been found effective to reduce the phosphorus content in the nickel deposit. However, the critical narrow concentration limits of thiourea in the electroless nickel bath to provide satisfactory operation of the bath makes thiourea impractical for commercial plating installations because the analysis and replenishment of the bath to maintain proper composition parameters is difficult, time consuming and expensive.

Furthermore, new environmental directives from Europe and Asia have been enacted to reduce the amount of toxic materials entering the environment by limiting the amount of certain toxic substances allowed in a manufactured product and providing for the recyclability of the manufactured product. Two major directives are the End of Life Vehicle (ELV) Directive and the Restriction of Hazardous Substance (RoHS) Directive. The focus of the ELV Directive is to reduce the amount of heavy metals contained in an automobile and provide for the recyclability of automobile components. The focus of the RoHS Directive is the restriction of the use of hazardous substances in electrical and electronic equipment. The primary heavy metals addressed in these regulations are cadmium, lead, hexavalent chromium, and mercury. In electroless nickel plating, cadmium and lead are the major concerns. The ELV and RoHS Directives specify the limits for cadmium and lead in an electroless nickel deposit at less than 100 and 1,000 ppm, respectively.

Lead is a powerful stabilizer, effective at low concentrations, easy to control, and inexpensive, while cadmium is a very good brightener. Like lead, it is very effective at low concentrations, easy to control, and inexpensive. These properties have ensured lead and cadmium's widespread use in electroless nickel formulations. Thus, one challenge in electroless nickel baths is identifying alternative stabilizers and brighteners to the conventionally accepted and proven lead and cadmium.

Since the bath has a tendency to become more acidic during its operation due to the formation of hydrogen ions, the pH is periodically or continuously adjusted by adding bath soluble and compatible buffers, such as acetic acid, propionic acid, boric acid and the like.

Generally, the deposition rates of the nickel alloy are a function of the particular nickel chelating agent employed, the pH range of the bath, the particular bath components and concentrations, the substrate employed for the deposit and the temperature of the plating bath. However, accelerators may be added to overcome the slow plating rate imparted by complexing agents. If used, the accelerators may include, sulfur-containing heterocycles such as saccharine, as described, for example, in U.S. Pat. No. 7,846,503 to Stark et al., the subject matter of which is herein incorporated by reference in its entirety.

U.S. Pat. No. 3,953,624 to Arnold, the subject matter of which is herein incorporated by reference in its entirety, describes a method in which the metal content of the bath is allowed to become depleted to a low value at the end of each production run. The bath is discarded at the end of each production run and a new bath is made up for a new run to produce a high level of consistency at a low cost in the initially used chemicals.

U.S. Pat. No. 6,020,021 to Mallory, Jr., the subject matter of which is herein incorporated by reference in its entirety, describes a method for plating an electroless nickel phosphorus containing alloy deposit on a substrate. The electroless nickel bath employs a hypophosphite reducing agent, is operated under electroless nickel plating conditions, and employs a certain type of a nickel chelating agent within the bath at a particular pH range.

Finally, when electroless nickel deposits are made on certain substrates, the electroless nickel deposit can develop cracking, blistering, surface distortion, and adhesion failure. It is generally believed that these undesirable properties are the result of deposits that exhibit a high tensile stress and that these problems can be resolved by producing a deposit that has a low tensile stress. EP Pat. Pub. No. 0 071 436 describes the use of a plating bath that contains a tensile strength reduction agent in order to produce an electroless nickel deposit having low tensile stress.

Bath stability is a primary concern in electroless nickel plating. An unstable bath affects production throughput, reject rates, and amount of solution maintenance required. Thus, there remains a need in the art for improved electroless nickel plating solutions that are capable of producing a plated deposit having a consistent high phosphorus content, that is capable of passing nitric acid testing, and that produces an electroless nickel deposit having low tensile stress.

SUMMARY OF THE INVENTION

It is an object of the present invention to provide a nickel phosphorus plating bath that is capable of depositing a nickel phosphorus alloy deposit on a substrate where the plated deposit has a high phosphorus content.

It is another object of the present invention to provide a method of plating a nickel phosphorus alloy on a substrate where the plated deposit has a high phosphorus content and is plated at a high deposition rate.

It is still another object of the present invention to provide a method of plating a nickel phosphorus alloy on a substrate where the plated deposit has a high phosphorus content and is capable of passing nitric acid testing.

It is still another object of the present invention to provide a method of plating a nickel phosphorus alloy on a substrate in which the plated deposit exhibits a low tensile stress.

In one embodiment, the present invention relates generally to an electroless nickel plating solution comprising:

a) a source of nickel ions;
b) a reducing agent comprising a hypophosphite; and
c) a chelation system comprising:
  i) one or more dicarboxylic acids; and
  ii) one or more alpha hydroxy carboxylic acids;

wherein the electroless nickel plating solution produces a nickel deposit having a phosphorus content that remains at about 12% throughout the lifetime of the electroless nickel plating solution.

In another embodiment, the present invention relates generally to a method of producing an electroless nickel phosphorus deposit on substrate, wherein the electroless nickel phosphorus deposit has phosphorus content of about 12%, the method comprising the steps of:

contacting the substrate with an electroless nickel phosphorus plating solution comprising:
  a) a source of nickel ions;
  b) a reducing agent comprising a hypophosphite; and
  c) a chelation system comprising:
    i) one or more dicarboxylic acids; and
    ii) one or more alpha hydroxy carboxylic acids;

for a period of time to provide a nickel phosphorus deposit on the substrate having a phosphorus content of about 12%;

wherein the electroless nickel plating solution produces a nickel deposit having a phosphorus content that remains at about 12% throughout the lifetime of the electroless nickel plating solution.

DETAILED DESCRIPTION OF THE PREFERRED EMBODIMENTS

The present invention relates generally to an electroless nickel plating solution comprising:

a) a source of nickel ions;
b) a reducing agent comprising a hypophosphite; and
c) a chelation system comprising:
  i) one or more dicarboxylic acids; and
  ii) one or more alpha hydroxy carboxylic acids;

wherein the electroless nickel plating solution produces a nickel deposit having a phosphorus content that remains at about 12% throughout the lifetime of the electroless nickel plating solution.

The use of the chelation system described herein in the electroless nickel plating solution produces a nickel deposit having a phosphorus content that remains in the 12% range throughout the life of the bath. This is unique in nickel phosphorus systems, because normally the phosphorus content starts at about 10% to 11% and then climbs to 12%.

The nickel ions are introduced into the bath employing various bath soluble and compatible nickel salts such as nickel sulfate hexahydrate, nickel chloride, nickel acetate, and the like to provide an operating nickel ion concentration ranging from about 1 up to about 15 g/L, more preferably about 3 to about 9 g/L, and most preferably about 5 to about 8 g/L.

The hypophosphite reducing ions are introduced by hypophosphorous acid, sodium or potassium hypophosphite, as well as other bath soluble and compatible salts thereof to provide a hypophosphite ion concentration of about 2 up to about 40 g/L, more preferably about 12 to 25 g/L, and most preferably about 15 to about 20 g/l.

The specific concentration of the nickel ions and hypophosphite ions employed will vary depending upon the relative concentration of these two constituents in the bath, the particular operating conditions of the bath and the types and concentrations of other bath components present.

The temperature employed for the plating bath is in part a function of the desired rate of plating as well as the composition of the bath. The plating bath is preferably maintained at a temperature of between about room temperature and about 100° C., more preferably between about 30° and about 90° C., most preferably between about 40° to about 80° C.

The complexing of the nickel ions present in the bath retards the formation of nickel orthophosphite which is of relatively low solubility and tends to form insoluble suspensoids which not only act as catalytic nuclei promoting bath decomposition but also result in the formation of coarse or rough undesirable nickel deposits. The inventors have also found that the addition of the chelators described herein does not affect the phosphorus content of the deposit or hurt the nitric acid test. That is, unlike any of the currently known high phosphorus electroless nickel deposits, the electroless nickel phosphorus deposit of the present invention maintains phosphorus content throughout the life of the bath and does not fail nitric acid testing. In fact, the inventors of the present invention have not been able to change the phosphorus content of the deposit from 12% with any of the tests that were carried out.

The one or more dicarboxylic acids are selected from the group consisting of oxalic acid, malonic acid, succinic acid, glutaric acid, adipic acid and pimelic acid and the one or more alpha hydroxy carboxylic acids are selected from the group consisting of glycolic acid, lactic acid, malic acid, citric acid and tartaric acid. Malonic acid is most preferred.

In one preferred embodiment, the plating solution comprises:

a) about 30 to about 40 g/L, more preferably about 33 to about 36 g/L, of hypophosphite;
b) about 30 to about 40 g/L, more preferably about 33 to about 36 g/L, of lactic acid;
c) about 3 to about 6 g/L, more preferably about 4 to about 5 g/L, of succinic acid; and
d) about 25 to about 35 g/L, more preferably about 28 to about 31 g/L of malonic acid.

The use of the chelation system described herein in the electroless nickel plating solution produces a nickel deposit having a phosphorus content that remains in the 12% range throughout the life of the bath. This is unique in nickel phosphorus systems, because normally the phosphorus content starts at about 10% to 11% and then climbs to 12%.

The electroless nickel plating solution preferably has a pH of between about 5.2 to about 6.2, more preferably about 5.6 to about 5.7. When the pH of a conventional high phosphorus bath is raised above about 4.9 to 5.0, the phosphorus content of the bath drops and the plating speed increases. This has not allowed a high phosphorus bath to plate above a plating speed of about 0.5 mil/hour and achieve an acceptable phosphorus content of greater than 10%. However, using the unique chelation system described herein, the inventors of the present invention have been able to obtain a deposit having a phosphorus content of 12% from a plating bath having a pH of 5.7 and at a plating rate of at least about 0.9 mil/hour.

The electroless nickel plating using the chelation system described herein is also capable of handling a sulfur compound such as a compound bearing one or more sulfur-containing groups such as —SH (mercapto group), —S— (thioether group), C═S (thioaldehyde group, thioketone group), —COSH (thiocarboxyl group), —CSSH (dithiocarboxyl group), —$CSNH_2$ (thioamide group) and —SCN (thiocyanate group, isothiocyanate group). The sulfur-containing compound may be either an organic sulfur compound or an inorganic sulfur compound. Specific compounds include compounds selected from the group consisting of thioglycolic acid, thiodiglycolic acid, cysteine, saccharin, thiamine nitrate, sodium N,N-diethyl-dithiocarbamate, 1,3-diethyl-2-thiourea, dipyridine, N-thiazole-2-sulfamylamide, 1,2,3-benzotriazole 2-thiazoline-2-thiol, thiazole, thiourea, thiozole, sodium thioindoxylate, o-sulfonamide benzoic acid, sulfanilic acid, Orange-2, Methyl Orange, naphthionic acid, naphthalene-.alpha.-sulfonic acid, 2-mercaptobenzothiazole, 1-naphthol-4-sulfonic acid, Scheffer acid, sulfadiazine, ammonium rhodanide, potassium rhodanide, sodium rhodanide, rhodanine, ammonium sulfide, sodium sulfide, ammonium sulfate etc. thiourea, mercaptans, sulfonates, thiocyanates, and combinations of one or more of the foregoing. The inventors of the present invention have found that an electroless nickel plating solution using the chelation system described by herein is capable of handling one of the above described sulfur compounds as a stabilizer without failing nitric acid testing. It was previously believed that a high phosphorus plating compositions containing a sulfur compound would fail nitric acid testing. Typically, stabilizer systems for high phosphorus electroless nickel include iodine compounds with small amounts of lead or antimony or tin. Small amounts of bismuth will also fail nitric acid testing and thus the use of bismuth has never been an acceptable alternative for use in high phosphorus systems.

In one embodiment, the present invention describes an ELV-compatible system that contains iodine as the stabilizer for the electroless nickel plating bath without the inclusion of any heavy metals such as lead or antimony. In one preferred embodiment, the electroless nickel plating solution of the invention contains about 100 to about 140 mg/L of an iodine compound, more preferably about 110 to about 130 mg/L, and most preferably about 115 to about 125 mg/L of the iodine compound. Suitable iodine compounds include potassium iodate, sodium iodate and ammonium iodate. In a preferred embodiment, the iodine compound is potassium iodate.

In addition to the iodine compound, the stabilizer component may also preferably contain a sulfur compound. One suitable sulfur compound is saccharin which is used in an amount of between about 150 to 250 mg/L, more preferably about 175 to 225 mg/L, and most preferably about 190 to about 210 mg/L. Other sulfur compounds described herein would also be usable in combination with the iodine compound to stabilizer the electroless nickel plating bath.

The electroless nickel plating bath may also comprise a brightener system. In one embodiment, the brightener system of the invention comprises a bismuth/taurine brightener system comprising about 2 to about 4 mg/L, more preferably about 2.5 to about 3.5 mg/L of bismuth and about 0.5 to about 3 mg/L, more preferably about 1.0 to about 1.5 mg/L taurine. In addition, the pH of the plating bath was increased to 6.1 because the stabilizer would be expected to slow down the plating rate. In this instance, a plating deposit was produced having a phosphorus content of 12%, a gloss of 120 and a plating rate of about 0.75 mil/hour.

In another embodiment, the present invention relates generally to a method of producing an electroless nickel phosphorus deposit on substrate, wherein the electroless nickel phosphorus deposit has phosphorus content of about 12%, the method comprising the steps of:

contacting the substrate with an electroless nickel phosphorus plating solution comprising:
- a) a source of nickel ions;
- b) a reducing agent comprising a hypophosphite; and
- c) a chelation system comprising:
  - i) one or more dicarboxylic acids; and
  - ii) one or more alpha hydroxy carboxylic acids;

for a period of time to provide a nickel phosphorus deposit on the substrate having a phosphorus content of about 12%;

wherein the electroless nickel plating solution produces a nickel deposit having a phosphorus content that remains at about 12% throughout the lifetime of the electroless nickel plating solution.

The lifetime of the electroless nickel plating solution is defined in terms of metal turnovers (MTO). In one embodiment, the lifetime of the electroless nickel plating solution comprises at least 3 metal turnovers, more preferably, the lifetime of the electroless nickel plating solution comprises at least 5 metal turnovers.

The plating rate of the electroless nickel solution on the substrate is preferably at least 0.5 mil/hour, more preferably at least 0.9 mil/hour.

Additionally, depending on the high phosphorus system, the stress of the deposit is normally in the range of between about 20,000 and 30,000 which is too high for many applications. The inventors of the present invention have also discovered that thiourea may be continuously added to the replenisher solution to maintain a stress of less than 15,000 PSI tensile at 5 MTO's, more preferably, less than about 2500 PSI tensile at 5 MTO's.

A range of about 0.2 to about 2.0 mg/l/MTO of thiourea, more preferably about 0.5 to about 1.5 mg/l/MTO of thiourea in the replenisher solution was found to reduce the stress of the deposit to about 2100 PSI and 5 MTO's.

The duration of contact of the electroless nickel solution with the substrate being plated is a function which is dependent on the desired thickness of the nickel-phosphorus alloy. The contact time can typically range from as little as about one minute to several hours. A plating deposit of about 0.2 to about 1.5 mils is a typical thickness for many commercial applications, while thicker deposits (i.e., up to about 5 mils) can be applied when wear resistance is desired.

During the deposition of the nickel alloy, mild agitation may be employed, including, for example, mild air agitation, mechanical agitation, bath circulation by pumping, rotation of a barrel for barrel plating, etc. The plating solution also may be subjected to a periodic or continuous filtration treatment to reduce the level of contaminants therein. Replenishment of the constituents of the bath may also be performed, in some embodiments, on a periodic or continuous basis to maintain the concentration of constituents, and in particular, the concentration of nickel ions and hypophosphite ions, as well as the pH level within the desired limits.

The invention will now be illustrated according to the following non-limiting example:

Example 1

A chelation system was prepared comprising:

| | |
|---|---|
| 34 g/L | lactic acid |
| 4.1 g/L | succinic acid |
| 30 g/L | malonic acid |

This chelation system was added to an electroless nickel plating solution comprising:

| | |
|---|---|
| 6 g/L | nickel sulfate |
| 20 g/L | sodium hypophosphite |

Temperature:

pH:

It was observed that the phosphorus content remained in the 12% range throughout the lifetime of the bath.

Additions of medium phosphorus chelators and sulfur compounds to the bath did not affect the phosphorus content of the bath or hurt the nitric acid test.

The nitric acid test is a quality control test for electronic components. The standard nitric acid test is a test of passivity and consists of immersing a coated coupon or part into concentrated nitric acid (approximately 70 wt. %) for 30 seconds. If the coating turns black or grey during the immersion, it fails the test.

In this instance, coatings prepared in accordance with Example 1 passed the nitric acid test.

In addition, the neutral salt spray (NSS) test is a measure of the degree of corrosion, blistering, or under-creep of the test samples after exposure to very harsh weathering conditions in a controlled environment. It is conducted according to AS 2331.3.1 (Methods of test for metallic and related coatings). This accelerated test consists of a solution of salt and water sprayed at test samples for a continuous period of 1,000 hours. The test simulates the performance of the coated mesh in a coastal and corrosive environment.

Coatings prepared in accordance with Example 1 also passed the NSS test.

The nitric acid test is actually a test of passivity and was originally developed by the RCA Labs in New Jersey in the 1960's as a quality control test for incoming electronic components. The standard nitric acid test is an immersion of a coated coupon or part into concentrated nitric acid (70 percent by weight concentration) for 30 seconds. If the costing turns black or grey during the immersion, it fails the test.

What is claimed is:

1. A method of producing an electroless nickel phosphorus deposit on a substrate, wherein the electroless nickel phosphorus deposit has a phosphorus content of about 12%, the method comprising the steps of:

contacting the substrate with an electroless nickel phosphorus plating solution comprising:
- a) a source of nickel ions;
- b) a reducing agent comprising a hypophosphite;

c) a chelation system comprising:

i) one or more dicarboxylic acids; and ii) one or more alpha hydroxy carboxylic acids; and d) a brightener comprising bismuth;

for a period of time to provide a nickel phosphorus deposit on the substrate having a phosphorus content of about 12%;

wherein the electroless nickel phosphorous plating solution has a lifetime and produces a nickel phosphorous deposit having a phosphorus content that remains at about 12% throughout the lifetime of the electroless nickel phosphorous plating solution wherein the electroless nickel phosphorous plating solution deposits the nickel phosphorous deposit on the substrate at rate of at least 0.6 mil/hour.

2. The method according to claim 1, wherein the brightener comprises about 2 to about 4 mg/L bismuth.

3. The method according to claim 1, wherein the lifetime of the electroless nickel phosphorous plating solution comprises at least 3 metal turnovers.

4. The method according to claim 3, wherein the lifetime of the electroless nickel phosphorous plating solution comprises at least 5 metal turnovers.

5. The method according to claim 1, wherein the electroless nickel phosphorous plating solution comprises:

a) about 30 to about 40 g/L of hypophosphite;

b) about 30 to about 40 g/L of lactic acid;

c) about 3 to about 6 g/L of succinic acid; and d) about 25 to about 35 g/L of malonic acid.

6. The method according to claim 5, wherein the electroless nickel phosphorous plating solution comprises:

a) about 33 to about 36 g/L of hyphophosphite;

b) about 33 to about 36 g/L of lactic acid;

c) about 4 to about 5 g/L of succinic acid; and d) about 28 to about 31 g/L of malonic acid.

7. The method according to claim 1, wherein the electroless nickel phosphorous plating solution has a pH of about 5.2 to about 6.2.

8. The method according to claim 1, wherein the electroless nickel phosphorous plating solution comprises a stabilizer, wherein the stabilizer comprises one or more iodine compounds selected from the group consisting of potassium iodate, sodium iodate, and ammonium iodate.

9. The method according to claim 8, wherein the stabilizer does not comprise the metals cadmium, lead, hexavalent chromium or mercury.

10. The method according to claim 1, wherein the electroless nickel phosphorous plating solution further comprises a sulfur compound.

11. The method according to claim 10, wherein the sulfur compound is saccharin.

12. The method according to claim 1, wherein the electroless nickel phosphorous plating solution deposits the nickel phosphorous deposit on the substrate at a rate of at least 0.9 mil/hour.

13. The method according to claim 1, wherein the electroless nickel phosphorous deposit is capable of passing a standard nitric acid test, wherein the standard nitric acid test comprises immersing the electroless nickel phosphorous deposit on the substrate in a concentrated nitric acid solution for 30 seconds, wherein the electroless nickel phosphorous deposit on the substrate passes the nitric acid test if no discoloration of the electroless nickel phosphorous deposit is observed.

14. The method according to claim 7, wherein the electroless nickel phosphorous plating solution has a pH of about 5.6 to about 5.7.

* * * * *